United States Patent [19]

Raudys et al.

[11] 4,063,481

[45] Dec. 20, 1977

[54] ROTARY CUTTING DEVICE

[75] Inventors: Vytas Andrew Raudys; Ronald Robert DeVitto, both of Chicago, Ill.

[73] Assignee: Union Carbide Corporation, New York, N.Y.

[21] Appl. No.: 731,632

[22] Filed: Oct. 12, 1976

[51] Int. Cl.[2] ..... B26D 7/00

[52] U.S. Cl. ..... 83/199; 83/441; 83/580

[58] Field of Search ..... 83/199, 200, 580, 441

[56] References Cited

U.S. PATENT DOCUMENTS

| | | | |
|---|---|---|---|
| 2,249,575 | 7/1941 | O'Brien et al. | 83/199 X |
| 2,418,027 | 3/1947 | Gubelmann | 83/199 X |
| 3,149,518 | 9/1964 | Winestock | 83/199 X |
| 3,793,917 | 2/1974 | Flower et al. | 83/199 X |

*Primary Examiner*—J. M. Meister

*Attorney, Agent, or Firm*—Cornelius F. O'Brien

[57] ABSTRACT

A guiding and rotary cutting device for severing strips of tape or the like comprising a cylindrical guide post having a slot, preferably tapered, extended transversely through said post and a hollow cylindrical rotatable knife coaxially mounted about the post, said rotatable knife having a longitudinal slot disposed adjacent to and in alignment with the longitudinal first opening of the slot in the guide post and a longitudinal knife slot disposed adjacent to and in alignment with the longitudinal second opening of the slot in the guide post such that upon rotation of the cylindrical knife, a tape or the like protruding out from the longitudinal second opening in the guide post will be severed by the longitudinal knife edge defining the knife slot in the cylindrical knife.

1 Claim, 3 Drawing Figures

ROTARY CUTTING DEVICE

FIELD OF THE INVENTION

The present invention relates to a rotary cutting device that has guide means housed within said device for directing, supporting and positioning a material to be cut in alignment with the cutting blade of the device.

BACKGROUND OF THE INVENTION

It is common practice in the art to cut a strip of tape, wire or the like, with a scissor type cutting instrument or with a guillotine type cutting device. Basically, a knife edge or blade is forced into contact with and through the material being cut. Scissor type devices employ two blades whose cutting edges slide past each other thereby severing any material placed between the blades. Guillotine type cutting devices usually employ a movable blade that is guided against and onto a block or into a groove in a block such that any material placed between the blade and block can be severed. Regardless of the type cutting means employed, the material that is to be severed has to be guided by additional means so as to align the material with the cutting edge of the blade. In addition, once the severing operation is completed, the leading edge at the cut interface of the material is usually left unsupported so that it can move or otherwise be displaced from the cutting instrument. This latter feature is particularly undesirable when cutting a strip of tape into selected lengths since after each cut it will be necessary that the severed leading edge of the tape be guided, positioned, and supported in alignment with the cutting blade before the next segment of the tape can be severed.

It is an object of the present invention to provide a cutting device that has guide means housed within said device.

Another object of the present invention is to provide a cutting device that can support and maintain the leading cut edge of a material in alignment with the cutting blade after a segment of the material has been severed from said material.

Another object of the present invention is to provide a guiding and cutting device for use in severing a strip of tape or the like into desired lengths.

Another object of the present invention is to provide a cutting device that can guide, position and support a material in alignment with the cutting edge or blade of the device.

SUMMARY OF THE INVENTION

The invention relates to a rotary severing device comprising a substantially cylindrical guide post having a slot extended transversely through said post with the longitudinal first opening of said slot defined at one surface of the guide post and the longitudinal second opening of said slot defining at a second surface spaced apart from said first surface; a hollow substantially cylindrical knife coaxially mounted about said guide post and having a first longitudinal slot disposed adjacent to and in alignment with the first opening of the slot in the guide post, a second longitudinal slot disposed adjacent to and in alignment with the second opening of the slot in the guide post, and at least one of said longitudinal edges defining said second longitudinal slot in the cylindrical knife being a cutting edge; and wherein the cylindrical knife or guide post is rotatable so that the at least one cutting edge of the cylindrical knife is adapted for relative movement over the second opening in the guide post. It is also within the scope of this invention to have both the cylindrical knife and guide post rotate in opposite directions so as to effectively increase the relative movement of the cutting edge of the cylindrical knife over the respective slot in the guide post.

In the preferred embodiment of this invention, the slot in the guide post would be a tapered slot with the wide and narrow openings of the slot being the first and second openings, respectively, as described above. This tapered slot arrangement will provide a wider opening through which the material to be cut can be fed into the cutting device thereby effectively providing a better guidance for the material to the cutting edge of the device. In addition, in the preferred embodiment, the cylindrical knife would be rotatable while the guide post would be stationary as will be described below in conjunction with the drawing.

To provide a better cutting action in the device of this invention, one or both of the longitudinal edges defining the second or, in the preferred embodiment, the narrow opening of the slot in the guide post can be made a cutting edge. In this embodiment, the longitudinal cutting edge in the cylindrical knife will slide past the respective cutting edge in the guide post to produce a cutting action as commonly occurs in scissor or shearing type devices.

In another embodiment, the speed of cutting a strip of material into segments can be effectively doubled if both the longitudinal edges in a rotatable cylindrical knife are cutting edges. This increased cutting speed is obtainable by merely oscillating the rotatable cylindrical knife such that a segment of a strip protruding from longitudinal second or narrow opening in the slot of the guide post will be severed by a first cutting edge when the cylindrical knife is rotated in the clockwise direction and then when the rotation is reversed, a new segment of the strip can be fed through the guide post where it will then be severed by the second cutting edge of the cylindrical knife rotating in a counter-clockwise direction.

The width of the slot in the guide post will usually depend on the thickness of the material to be cut. In the preferred embodiment, the degree of the tapered slot in the guide post can vary depending on the size of the material to be cut; the rigidity of the material; and the degree of control means employed in directing the material to the tapered slot in the guide post. Preferably, the arc defining the width of the longitudinal slots in the cylindrical knife should be greater than the arc defining the width of the respective longitudinal openings of the slot in the guide post so as not to block or otherwise restrict the passage through said slot. The ratio of the width of the longitudinal first opening of the slot in the guide post to the width of the longitudinal second opening in the guide post can vary between about 1:1 and 50:1 for most applications, and preferably between about 3:1 and 6:1. It is to be understood that the width of the longitudinal second or narrow opening of the slot in the guide post will generally depend on the thickness of the material to be cut.

Materials that are suitable to be used with the cutting device of this invention include metal tape, filament tape, plastic tape, such as polyester, polypropylene, nylon or the like.

The cutting device of this invention is admirably suited for use as a component part in an apparatus for providing a hanger-clip closure for casings, said apparatus being of the type disclosed in a concurrently filed U.S. application Ser. No. 731,372, now U.S. Pat. No. 4,044,450 in the names of the same applicants as the subject invention.

DETAILED DESCRIPTION

Figure 1:
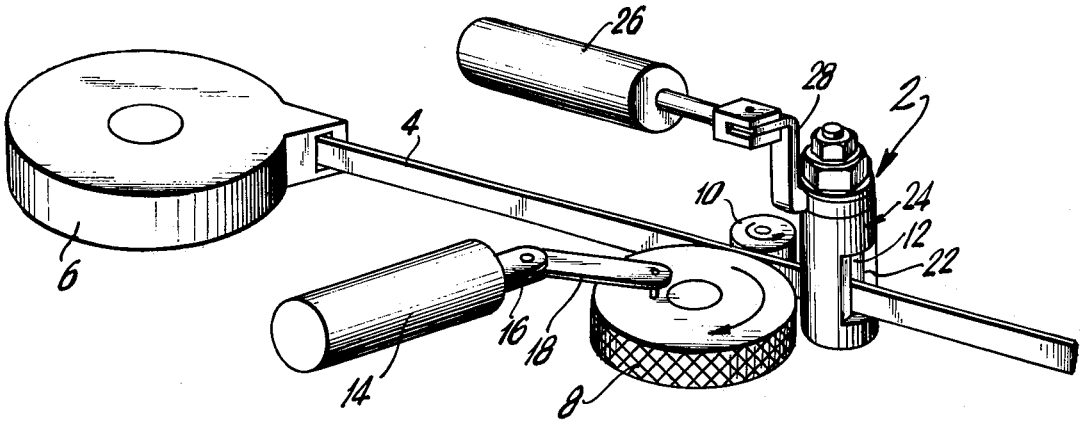
FIG. 1 is a schematic perspective view of the cutting device of this invention being used with conventional tape metering means.
Figure 2:
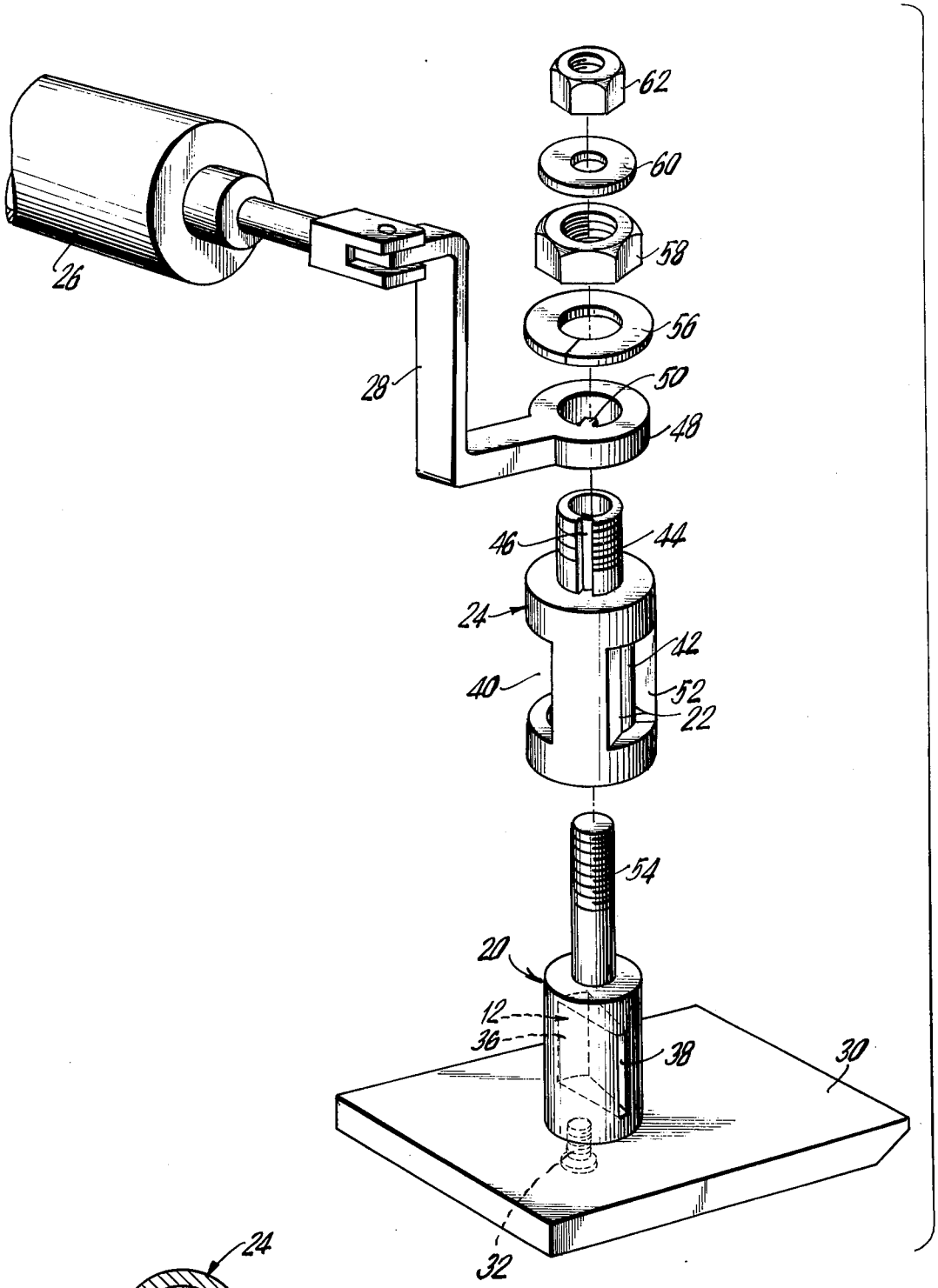
FIG. 2 is an exploded perspective view of the cutting device shown in FIG. 1.
Figure 3:
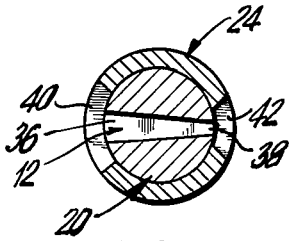
FIG. 3 is a mid-cross sectional view of the cylindrical guide post 20 and rotatable cylindrical knife 24 of FIG. 2 shown in the assembled state as illustrated in Fig. 1.

In FIG. 1 there is shown a cutting device 2 of this invention being employed to cut a predetermined length of semi-rigid tape 4 being fed from a supply source 6. Initially, the edge of the tape 4 is advanced and positioned between a tape feed gripper roll 8 and tape feed compression roll 10 whereupon it is fed through tapered slot 12 of cutting device 2. Specifically, actuation and inactuation of air cylinder 14 by conventional means (not shown) advances and retracts, respectively, piston 16 coupled to slider crank 18 which rotates tape feed gripper roll 8 one complete revolution. As shown in FIGS. 1 to 3, the rotation of gripper roll 8 causes tape 4 to feed through tapered slot 12 of guide post 20 where it then projects out from the narrow opening 38 of said tapered slot 12 thus aligning tape 4 with the cutting edge 22 of the cylindrical knife 24. Thereafter pneumatic cylinder 26 is actuated to advance linkage 28 which, in turn, rotates rotary knife 24 such that the cutting edge 22 severs tape 4 at the exit of the tapered slot 12.

As shown in FIGS. 2 and 3, a cylindrical guide post 20 fixedly supported on base 30 via screw means 32 has a tapered slot 12 extending transversely through said guide post 20 for guiding a tape or like material from the wide angle opening 36 out through the narrow angle opening 38. Coaxially mounted about guide member 20 is rotary knife 24 which is in the form of a cylindrical member having longitudinal slot 40 and knife slot 42 adapted to be aligned with openings 36 and 38, respectively, in guide post 20. Protruding from rotary knife 24 is a threaded member 44 having a slot 46 adapted for sliding within linkage boss 48 extending from linkage 28, said linkage boss 48 having longitudinal rib 50 for sliding within slot 46. Thus, when rotary knife 24 is slid over guide post 20, and linkage boss 48 is slid over threaded member 44, rotation of linkage boss 48 will rotate knife 24 thereby effecting a severing action by the cutting edge 22 and/or 52 defining knife slot 42 at the opening 38 of guide post 20 as shown in FIG. 3 which is a cross-sectional view of the guide post 20 and rotary knife 24 after they have been assembled. To secure the rotary knife assembly together, the guide post 20 has a projected threaded member 54 which projects through and above projected threaded member 44 of rotary knife 24 and through and above linkage boss 48. A lock washer 56 is disposed over projected members 54 and 44 and seats on linkage boss 48. Thereafter nut 58 is secured to the threaded area on projection 44 followed by a thrust washer 60 and prevailing torque nut 62, the latter of which is threadably secured to the threaded area on projected member 54.

Thus with the cutting device fully assembled, the rotatable knife 24 can be rotated to efficiently cut any material projecting out from the opening 38 in the tapered slot 12 of guide post 20.

It should be understood that the foregoing disclosure relates to preferred embodiments of the invention and it is intended to cover all changes and modifications of the invention which do not depart from the spirit and scope of the appended claims.

What is claimed is:

1. A rotary severing device comprising a substantially cylindrical guide post having a slot tapered extended transversely through said post with the longitudinal first opening of said slot defined at one surface of the guide post and being wider than the longitudinal second opening of said slot defined at a second surface spaced apart from said first surface; a hollow substantially cylindrical knife coaxially mounted about said guide post and having a first longitudinal slot disposed in alignment with the first opening of the slot in the guide post, a second longitudinal slot disposed adjacent to and in alignment with the second opening of the slot in the guide post, said first slot in the substantially cylindrical knife being wider than the width of the second slot so as to facilitate the guidance of material to be cut through the tapered slot, and at least one of said longitudinal edges defining said second longitudinal slot in the cylindrical knife being a cutting edge; and wherein the cylindrical knife or guide post is rotatable so that at least one cutting edge of the cylindrical knife is adapted for relative movement over the second opening in the guide post.

* * * * *

UNITED STATES PATENT OFFICE

CERTIFICATE OF CORRECTION

Patent No. 4,063,481 Dated December 20, 1977

Inventor(s) Vytas Andrew Raudys et al.

It is certified that error appears in the above-identified patent and that said Letters Patent are hereby corrected as shown below:

Claim 1, line 2, delete the word "slot" before "tapered" and add the word -- slot -- after "tapered".

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*